US005923288A

United States Patent [19]

Pedlow, Jr.

[11] Patent Number: 5,923,288

[45] Date of Patent: Jul. 13, 1999

[54] ANTENNA ALIGNMENT INDICATOR SYSTEM FOR SATELLITE RECEIVER

[75] Inventor: Leo Mark Pedlow, Jr., Ramona, Calif.

[73] Assignees: Sony Coporation, Tokyo, Japan; Sony Electronics, Inc., Park Ridge, N.J.

[21] Appl. No.: 08/827,034

[22] Filed: Mar. 25, 1997

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,893,288 | 1/1990 | Maier et al. | 342/359 |
| 5,519,405 | 5/1996 | Matsubara et al. | 342/359 |
| 5,561,433 | 10/1996 | Chaney, Jr. | 342/359 |
| 5,589,841 | 12/1996 | Ota | 343/760 |

*Primary Examiner*—Gregory C. Issing
*Attorney, Agent, or Firm*—Blakely, Sokoloff, Taylor & Zafman LLP

[57] ABSTRACT

An apparatus for aligning an antenna, for example an antenna of home satellite receiver system, includes means for detecting a received signal strength of a signal received at the antenna. Coupled to the detecting means are means for generating a display signal indicative of the received signal strength. The means for generating are configured to provide a first display signal when the received signal strength is in first state and to provide a second display signal when the received signal strength is in second state. Coupled to the means for generating the display signal are means for displaying the display signal. The means for displaying are capable of responding to both the first display signal and the second display signal. The first display signal may be a signal having a frequency proportional to the received signal strength. The second display signal may be a signal having a frequency proportional to the inverse of a difference between maximum received signal strength and a current received signal strength, thus providing a measure of antenna alignment error.

12 Claims, 7 Drawing Sheets

ANTENNA ALIGNMENT INDICATOR SYSTEM FOR SATELLITE RECEIVER

FIELD OF THE INVENTION

The present invention is related to antenna alignment systems and, more particularly, to those systems which rely on signal strength indication to achieve alignment.

BACKGROUND

With the advent of direct broadcast satellite receiver systems in the home, proper alignment of a receiving antenna for operation of such receivers has become a concern. FIG. 1 illustrates the basic alignment problem facing the user of a home satellite receiver. An antenna associated with the receiving system must be aligned in azimuth so as to receive a signal broadcast by the satellite. Typically, this alignment is performed by a user who rotates the antenna in azimuth until receiving an indication that an acceptable signal strength is presented to the receiver system. As shown in FIG. 2, as the antenna is rotated in azimuth, there will come a time at which a peak signal strength for a received signal presented from the antenna to the receiver system is achieved. As the antenna is rotated further in azimuth, the signal strength falls off according to the degree of misalignment.

Optimally, a user will adjust the antenna for the home satellite receiving system so that the antenna points in a direction coincident with the peak signal strength. Current home receiver systems employ an integral flashing indicator, for example an LED, at the receiving antenna to assist in this alignment. The LED blinks at a frequency proportional to the received signal strength. Accordingly, the user adjusts the alignment of the antenna until the flashing LED indicates proper alignment. However, the use of this alignment aid seldom results in optimal alignment of the antenna because of problems associated with the granularity of resolution achievable by the flashing LED and the inherent inability of a human user to detect slight variations in the frequency of the flashing light source.

Other home satellite receiver system manufacturers have implemented alignment systems which use audible tones, the frequency of which are proportional to the received signal strength. These methods have the same short comings as the flashing LED approach and, in addition, often require that the receiving dish antenna be within audible range of the user's television set (e.g., because the audible tone is broadcast through the television's speakers). In many cases this is impractical, requiring a means for relaying alignment commands between a user positioned at the television set, and therefore within range of the audible tone, and another user positioned at the antenna.

In would be desirable, therefore, to provide an improved means for optimally aligning an antenna for a home satellite receiver system.

SUMMARY OF THE INVENTION

In one embodiment, the present invention provides an apparatus for aligning an antenna, for example an antenna of home satellite receiver system. The apparatus includes means for detecting a received signal strength of a signal received at the antenna. Coupled to the detecting means are means for generating a display signal indicative of the received signal strength. The means for generating is configured to provide a first display signal when the received signal strength is in first state and to provide a second display signal when the received signal strength is in second state. Coupled to the means for generating the display signal are means for displaying the display signal. The means for displaying are capable of responding to both the first display signal and the second display signal. The first display signal may comprise a signal having a frequency proportional to the received signal strength. The second display signal may comprise a signal having a frequency proportional to the inverse of a difference between a maximum received signal strength and a current received signal strength.

BRIEF DESCRIPTION OF THE DRAWINGS

The present invention is illustrated by way of example, and not limitation, in the figures of the accompanying drawings in which.

DETAILED DESCRIPTION

A method and apparatus for achieving optimal antenna alignment using a flashing indicator is described. Although described with reference to certain specific embodiments, those skilled in the art will recognize that the present invention may be practiced without some or all of these details and, further, that other indicators, such as lamps, audio signal generators, visual display devices, or meters may be used instead of an indicator LED. The present invention improves the manner in which the indicator flashes. In particular, the indicator operates in two modes, which are switched automatically by a system receiver. The first mode illuminates the indicator solidly, extinguishing it periodically at a rate proportional to received signal strength. This mode remembers the highest level measured (i.e., a peak signal strength) and the system remains in this mode during antenna alignment so long as the received signal strength being measured increases or remains constant. The second mode is activated when the received signal strength begins decreasing. The second mode inverts the appearance of the indicator by changing to a periodic illumination, the frequency of which is proportional to the inverse of the difference between the measured peak signal strength and the current received signal strength. The system operates in this mode whenever the signal strength is less than the measured peak value. By operating in the second mode, the indicator graphically reports to a user that the antenna is no longer pointing in a direction corresponding to a peak received signal strength. Additionally, it provides a positive feedback mechanism to the user indicating just how far the antenna is from the optimal alignment position (i.e., the position corresponding to the peak received signal strength) because, when misaligned, the indicator blink rate is a function of pointing error, not just signal strength.

Figure 1:
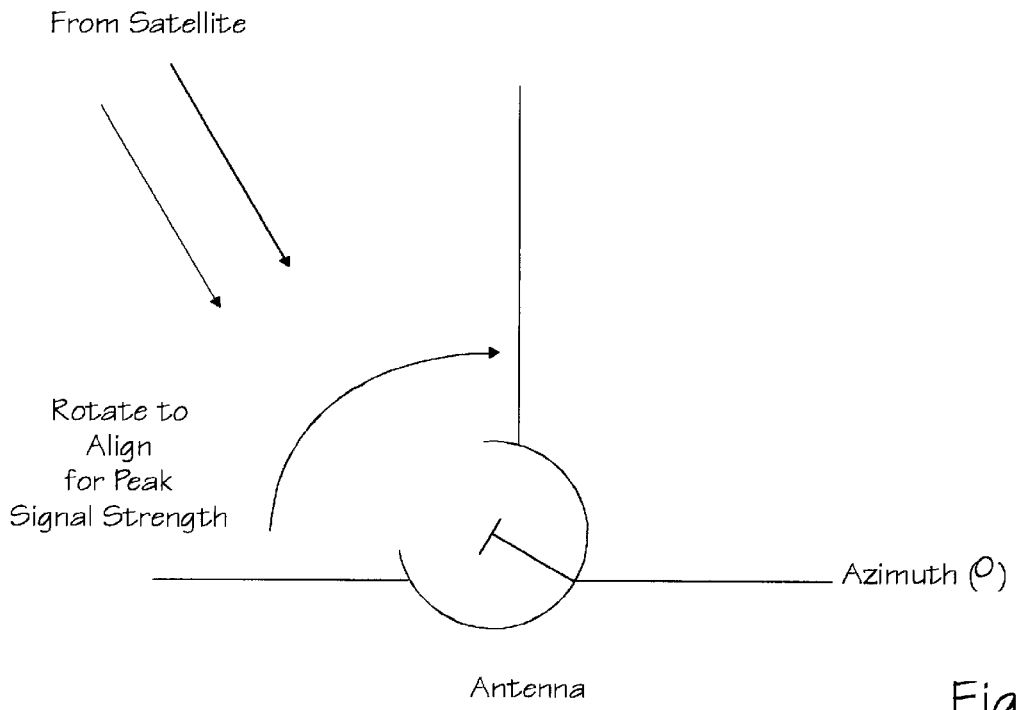
FIG. 1 illustrates the alignment of an antenna in azimuth.
Figure 2:
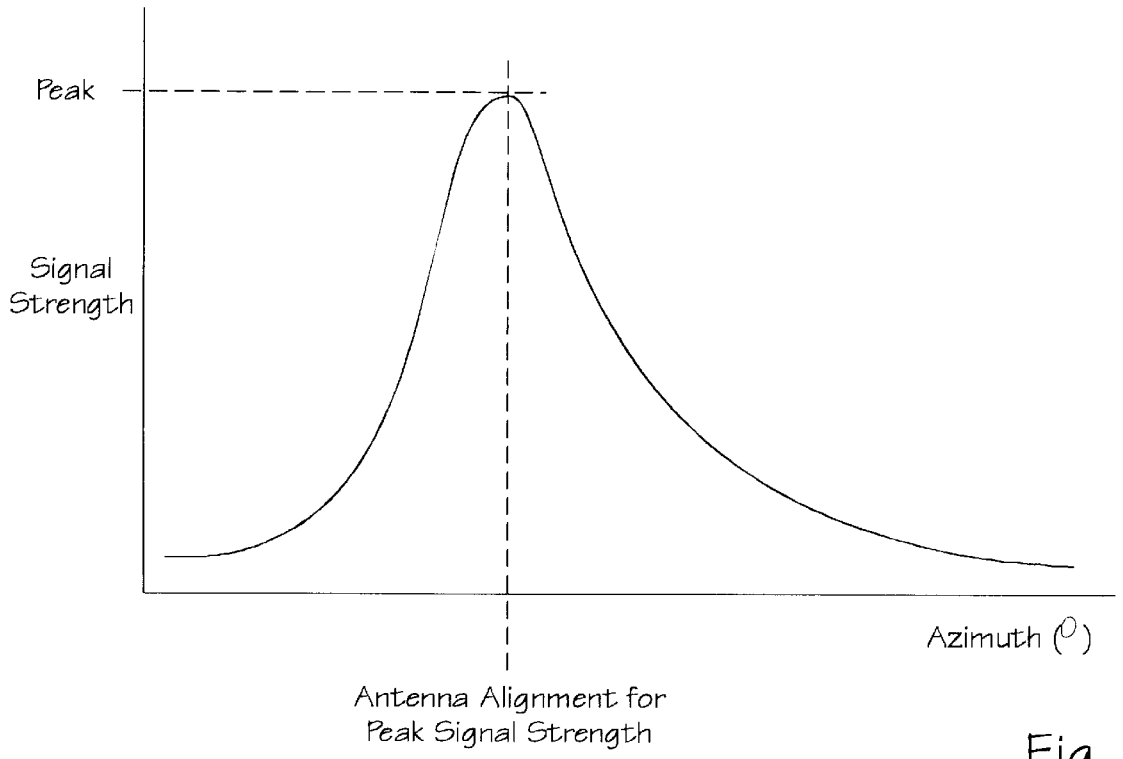
FIG. 2 illustrates a plot of received signal strength verses antenna position in azimuth.
Figure 3:
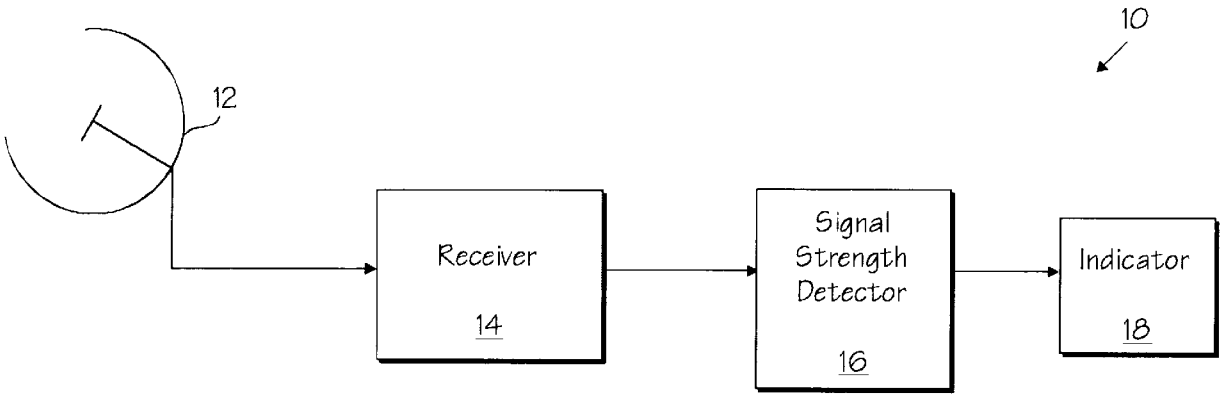
FIG. 3 illustrates a home satellite receiver system employing a signal strength detector and indicator according to one embodiment.

FIG. 3 illustrates a home satellite receiver system 10 which includes an antenna 12 coupled to a receiver 14. Antenna 12 is to be aligned so as to receive a signal broadcast by a satellite. When antenna 12 is aligned in an optimal position, the signal presented to receiver 14 from antenna 12 will have a maximum received signal strength.

Receiver system 10 also incorporates signal strength detector 16 and alignment indicator 18. Alignment indicator 18 may be any one of a number of indicators, including a flashing LED, an audio tone generator, a visual display (for example a graphical display on a television screen), a signal strength meter, or some other means of providing alignment information to a user. Signal strength detector 16 is described in more detail below. However, it should be appreciated that signal strength detector 16 may be an integral part of receiver 14. In addition, indicator 18 may be housed on antenna 12 (e.g., on a frame or mounting assembly or on a low noise amplifier), so as to provide an easy point of reference for a user aligning antenna 12.

Figure 4:
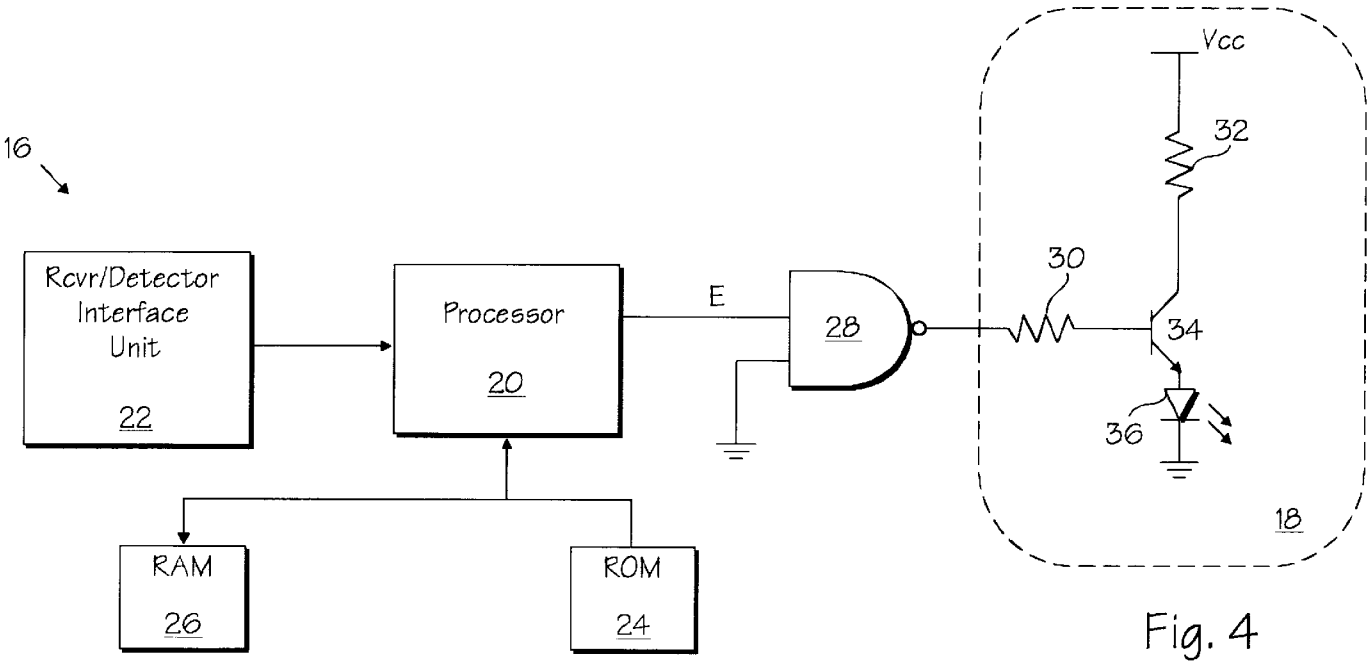
FIG. 4 illustrates one embodiment of a signal strength detector and indicator.

FIG. 4 illustrates one embodiment of signal strength detector 16 and indicator 18. For this embodiment, signal strength detector 16 includes a processor 20. Processor 20 may be a separate processor or a processor already used within receiver 14. Processor 20 receives an indication of received signal strength from receiver 14 via receiver/detector interface unit 22. Receiver/detector interface unit 22 provides proper electrical signal conditioning to the signal presented to processor 20. Processor 20 communicates over a bus with ROM 24 and RAM 26. ROM 24 may store computer readable instructions, such as those described below, for use by processor 20 during the alignment process. Processor 20 may use RAM 26 to provide temporary storage locations during the alignment process. It will be appreciated that processor 20 as illustrated in FIG. 4 may comprise a general purpose programmable microprocessor. In other embodiments, the functions of processor 20, ROM 24 and/or RAM 26 may be combined in a field programmable gate array or complex programmable logic device. Accordingly, the embodiment shown in FIG. 4 is for illustration only.

During the alignment process, processor 20 produces an intermediate signal E indicative of antenna alignment errors. This intermediate signal E is presented to NAND gate 28 which drives alignment indicator 18. For the embodiment illustrated, indicator 18 includes LED 36. In order to properly bias LED 36, resistors 30 and 32 are provided in conjunction with transistor 34. For the case where Vcc is 5 volts, resistor 30 may be 10 kΩwhile resistor 32 is 220 Ω. Transistor 34 may be a 2N2222 transistor.

The embodiment shown in FIG. 4 will drive LED 36 to approximately the supply voltage Vcc when the signals presented to the input of NAND gate 28 are different. That is, when processor 20 drives the intermediate signal E to logic low value, LED 36 will remain off. However, when processor 20 drives the intermediate signal E to a logic high value, the LED 36 will turn on. By varying the frequency at which the intermediate signal E is produced, processor 20 can control the flashing (or blinking) of LED 36.

Figure 5:
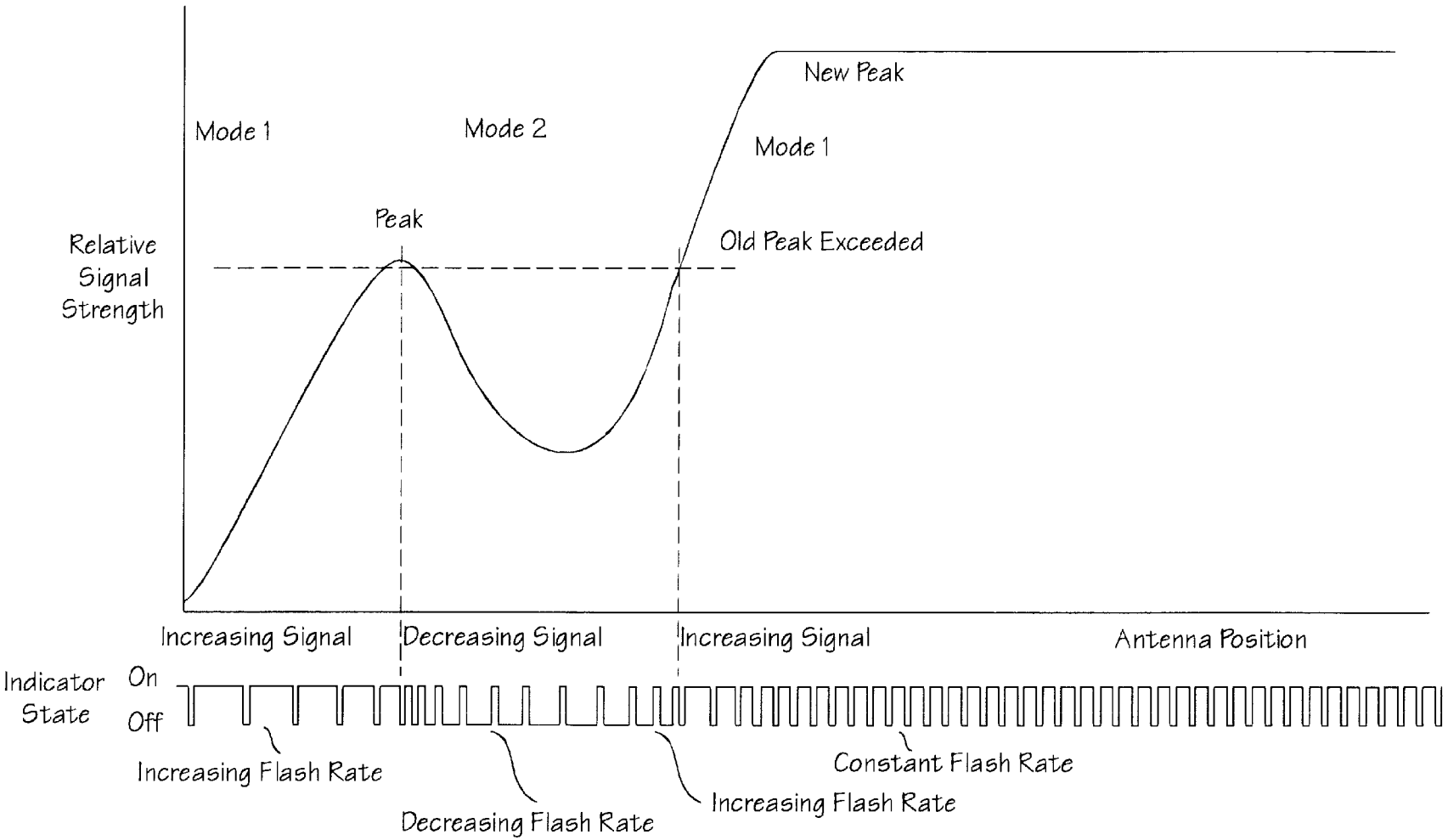
FIG. 5 illustrates the use of varying display signals according to one embodiment.

FIG. 5 is a graph depicting the relationship of received signal strength due to antenna positioning error and the corresponding state of the alignment indicator 18. The flash rate of alignment indicator 18 is a relative measure and is not shown to scale. In all cases, the narrow pulse widths are constant and may be an arbitrary value based upon the maximum flash rate, a desired power consumption, and user viewability of indicator 18.

As illustrated in FIG. 5, during times when the received signal strength is increasing, indicator 18 operates in mode 1. In mode 1, the appearance of indicator 18 is predominately lit (on) and indicator 18 flashes off at a rate proportional to the received signal strength. As antenna 12 is moved in azimuth, a peak signal strength may be found and reported to processor 20. As antenna 12 continues be rotated in azimuth, received signal strength falls off from the peak and signal strength detector 16 and indicator 18 enter mode 2. In mode 2, indicator 18 is predominately off (unlit) and experiences blinking at a rate which is proportional to the pointing error as presented by:

1/(peak signal strength—average measured signal strength)

As shown in FIG. 5, during alignment of antenna 12 a user may pass through various positions in azimuth which correspond to various peaks in received signal strength. These various peaks may correspond to, for example, multi-path transmissions of the broadcast satellite signal. As antenna 12 continues to be rotated in azimuth, one peak (labeled as "New Peak" in FIG. 5) may correspond to a greater received signal strength than all other peaks. This will typically be true for the case where the antenna 12 is optimally aligned to the broadcast satellite signal and is not experiencing multi-path reflections. In practice, the New Peak may be 3–4" wide in azimuth. At this point, signal strength detector 16 remains in mode 1 with a corresponding blink rate of indicator 18. (It will be appreciated that the duration of the New Peak has been exaggerated to show the corresponding steady blink rate of indicator 18.) This alerts the user that antenna 12 is now optimally aligned.

Figure 6:
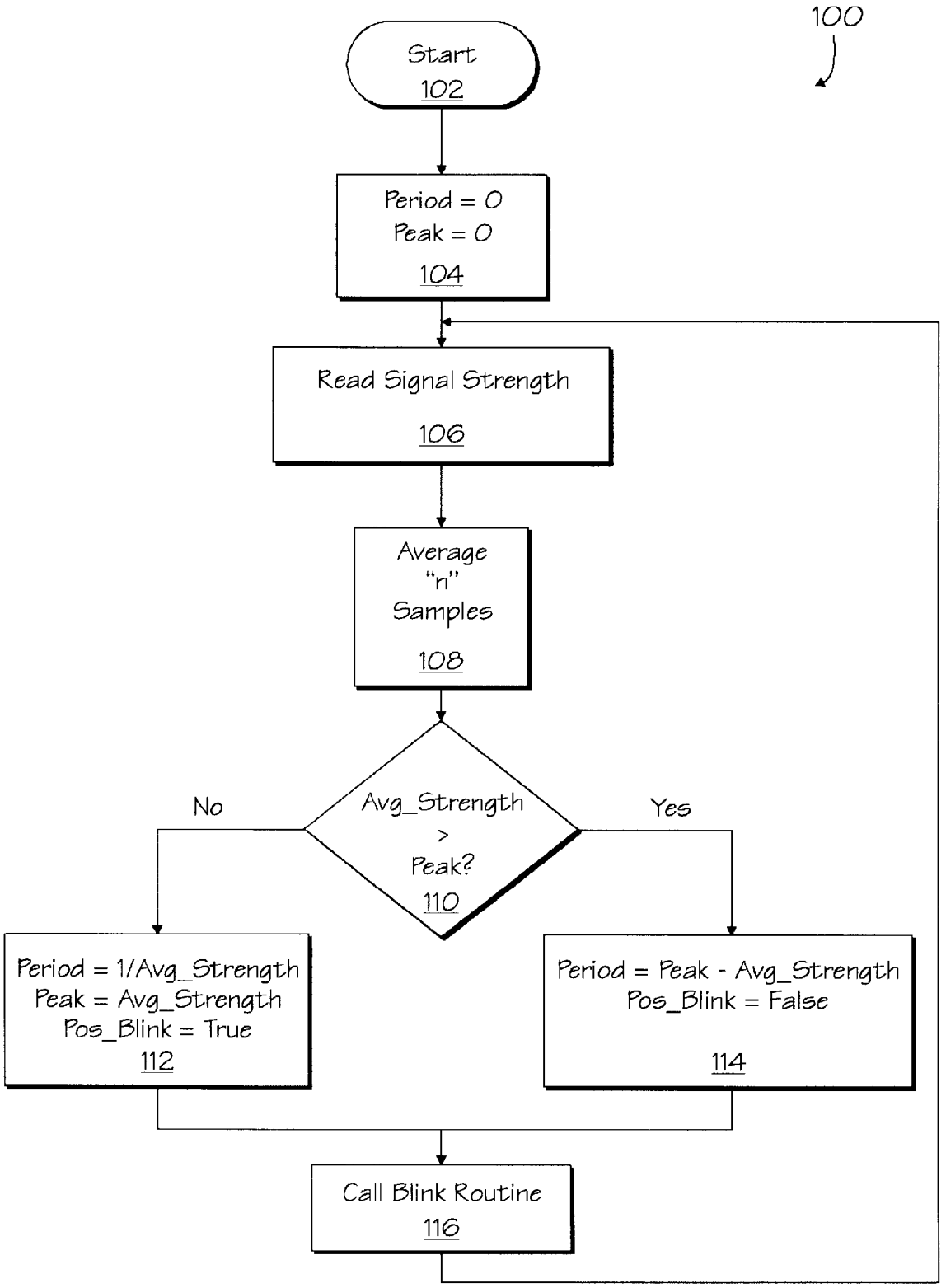
FIG. 6 is a flow diagram for setting an indicator blink mode and rate according to one embodiment.

FIG. 6 illustrates an indicator blink mode algorithm 100 for use by signal strength detector 16. It will be appreciated that computer readable instructions corresponding to this algorithm may be stored in ROM 24 for execution by processor 20. Indicator blink mode algorithm 100 begins at step 102 and, when called, proceeds to step 104 where two variables, Period and Peak, are set to 0. At step 106, processor 20 reads various signal strength values presented by receiver/detector interface unit 22. "N" samples (N is an arbitrary integer value greater than 1) are averaged at step 108 to produce an average received signal strength. At step 110, the average received signal strength is compared with a previously stored peak signal strength. If the average signal strength is less than or equal to the peak signal strength, process 100 proceeds to step 112. At step 112, the variable Period is set equal to the inverse of the average signal strength. The variable Peak is set equal to the average signal strength and a flag Pos_blink is set true. If, however, at step 110 the average signal strength is determined to be greater than the previous peak signal strength, process 100 proceeds to step 114 where the variable Period is set equal to a value which is the difference between the peak signal strength and the average signal strength and the variable Pos_blink is set false. When these variables have been set at either step 112 or step 114, process 100 proceeds to step 116 and calls a blink routine.

Figure 7:
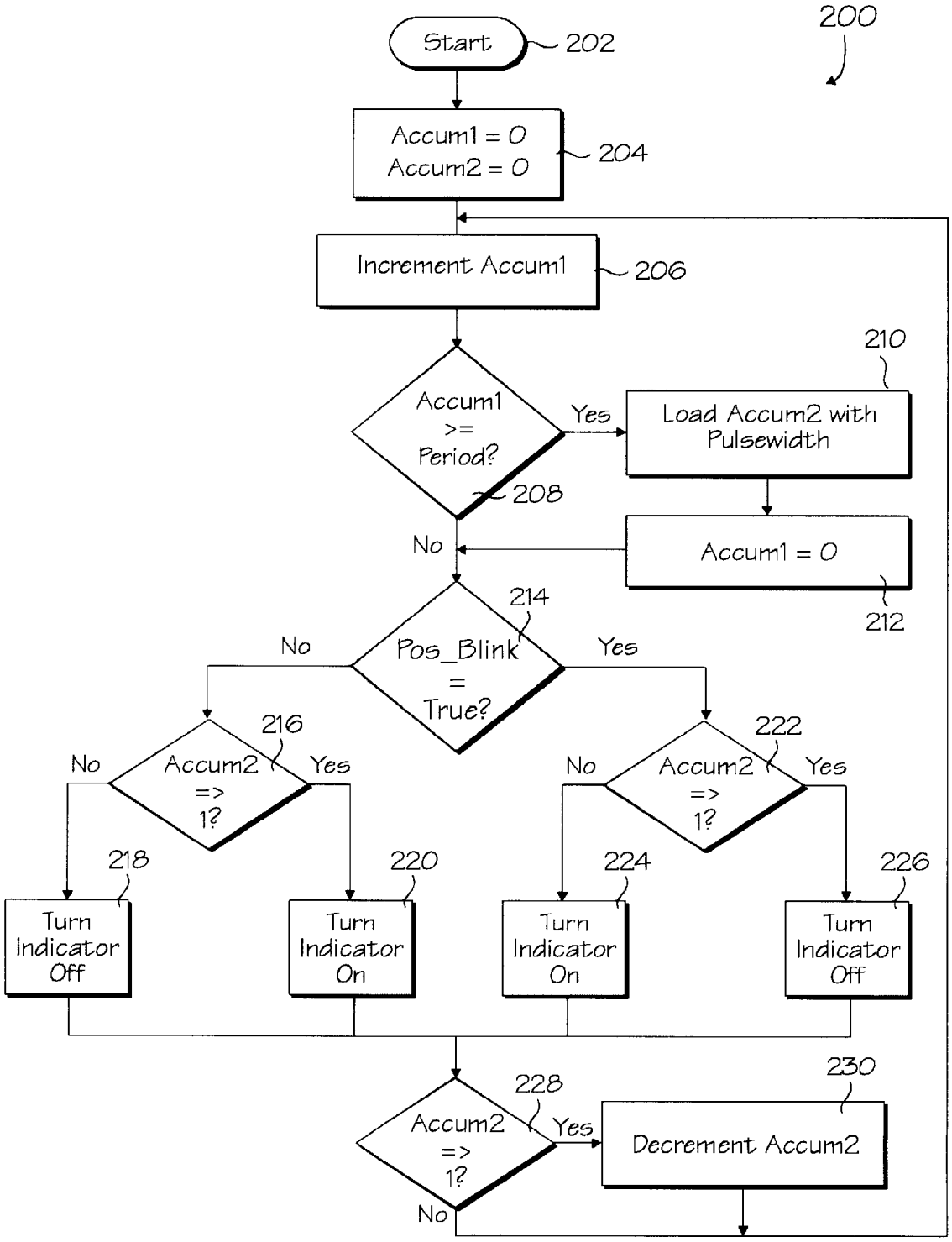
FIG. 7 is a flow diagram illustrating an indicator blink routine according to one embodiment.

FIG. 7 illustrates blink routine 200 in greater detail. When called at step 202, blink routine 200 proceeds to step 204 and sets two variables, Accum1 and Accum2 equal to 0. At step 206, blink routine 200 increments variable Accum1. At step 208 Accum1 is checked to see whether it is greater than or equal to the variable Period. If so, at step 210 variable Accum2 is loaded with a pulse width value and at step 212

Accum1 is set equal to 0. Otherwise, process 200 proceeds to step 214 where a check is made to see if the state of flag Pos_blink is true. If not, process 200 proceeds to step 216 where the variable Accum1 is checked to see whether it is less than or equal 1. If not, the indicator, e.g., LED 36, is turned off. Otherwise, at step 220, the indicator is turned on.

If the flag Pos_blink was true at step 214, a check is made at step 222 to determine if the value of Accum2 is less than or equal to 1. If not, the indicator is turned on at step 224, otherwise the indicator is turned off at step 226.

At step 228, the value at Accum2 is checked to see whether is greater than or equal to 1. If so, Accum2 is decremented at step 230 and process 200 returns to step 206. Otherwise, process 200 loops back to step 206 without decrementing the value of Accum2.

The variables used by the above discussed routines are as follows. Period is the period of the indicator blink rate. Peak is the highest measured signal strength value. The boolean flag Pos_blink is a state indicator. When set true, the indicator 18 is illuminated, when set false the indicator 18 is extinguished. Variable Accum1 is a counter for timing a blink period while variable Accum2 is a counter for timing a contrasting flash period. Pulse width indicates the period of the contrasting flash and may be user selectable.

Figure 8:
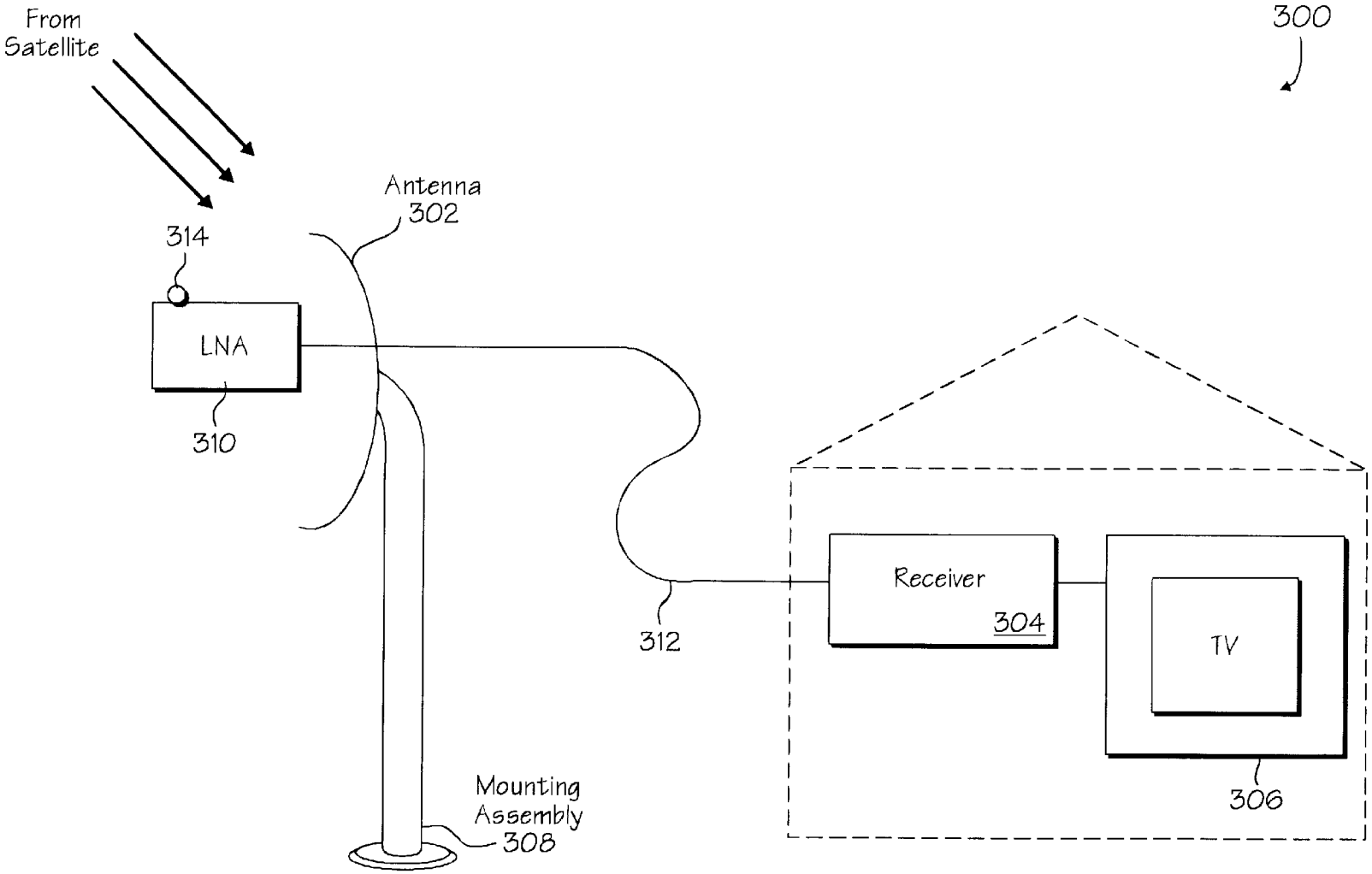
FIG. 8 illustrates a home satellite receiver system configured according to the present invention.

FIG. 8 shows a preferred embodiment of a home satellite television receiver system 300 configured according to the present invention. System 300 includes antenna 302, receiver 304 and television (TV) 306. Generally, antenna 302 will be positioned outside a home or other residence or building such that it has a clear view of the sky (to intercept signals broadcast by the orbiting satellite(s). Antenna 302 may be secured in position using mounting assembly 308. Mounting assembly 308 may be a bracket which is attached to a wall or other supporting structure or may be a pole fixed in the ground or otherwise secured to a relatively stable platform (e.g., a roof). Mounting assembly 308 is mechanically coupled to antenna 302 and will generally have means for rotably securing antenna 302 so as to permit antenna alignment Signals broadcast by one or more satellites are captured by antenna 302 and focused to a feedhorn assembly (not shown). Generally, a low noise amplifier (LNA) 310 will be positioned in close proximity to the feedhorn assembly so as to amplify the relatively weak signals gathered by antenna 302. LNA 310 may also downconvert these signals prior to transmission to receiver 302 across cable 312.

LNA 310 may also be fitted with LED 314 which will provide a visual reference for use during antenna alignment in accordance with the above-described procedures. Alternatively, LED 314 may be positioned on mounting assembly 308 or antenna 302. The precise positioning of LED 314 is not important so long as it will be visible by a user during the antenna alignment process.

Figure 9:
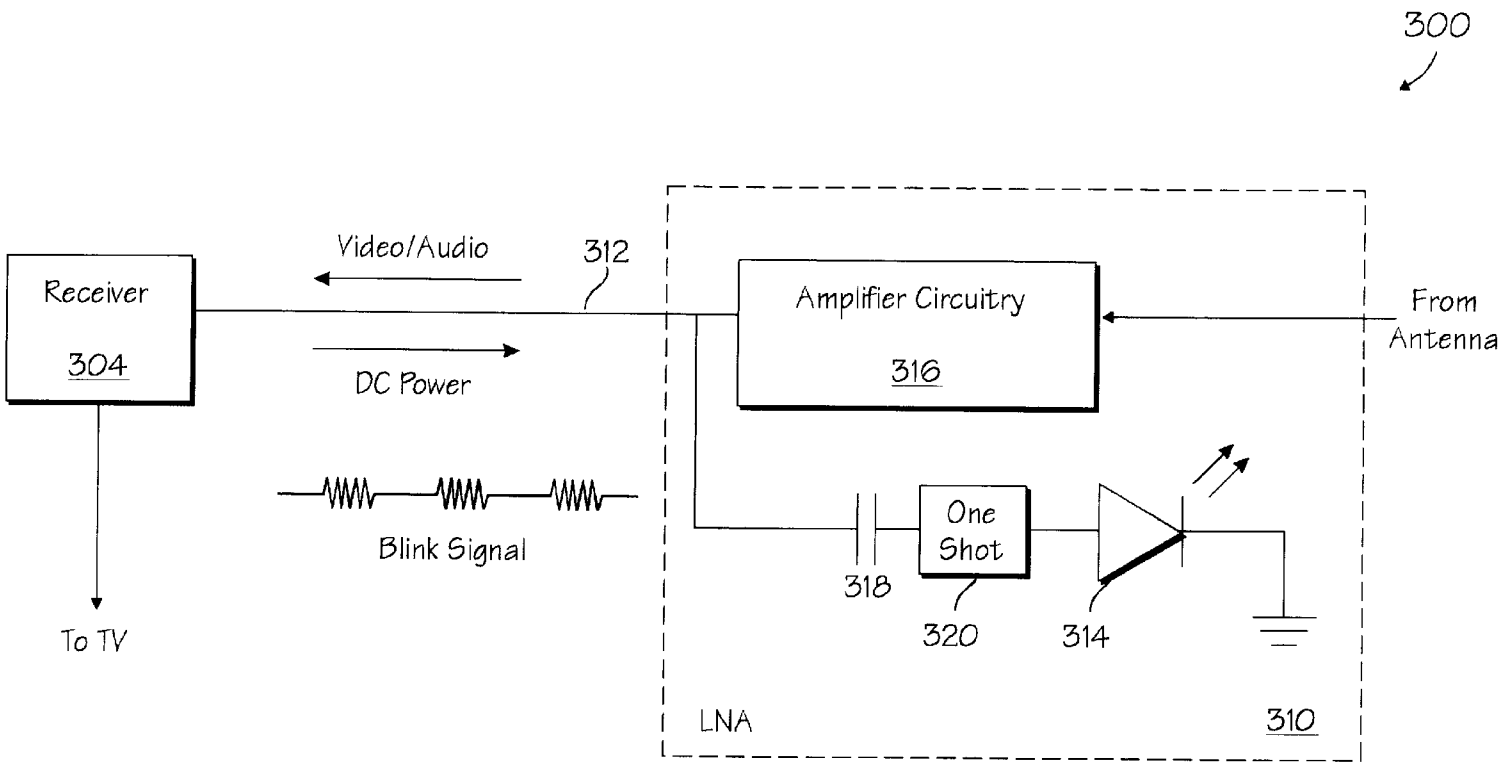
FIG. 9 illustrates a preferred method of providing a blink signal to a signal strength indicator.

FIG. 9 illustrates aspects of receiver system 300 in greater detail. As shown, signals from the antenna 302 are provided to amplifier circuitry 316 within LNA 310. The amplifier circuitry 316 amplifies and may also downconvert these signals prior to transmitting the signals to receiver 304 across cable 312. Cable 312 may be a two conductor coaxial cable as is commonly used in such receiver systems. The signals carried by cable 312 from LNA 310 to receiver 304 will be video and audio signals to be decoded prior to display on television 306.

Cable 312 may also be used to carry DC power from receiver 304 to LNA 310 to power amplifier circuitry 316. This way, a separate power source is not required for LNA 310. Superimposed on the DC power signal may be a blink signal used to illuminate LED 314. As illustrated, the blink signal is provided by receiver 304 to LNA 310 across cable 312 and in accordance with the procedures described above. The blink signal includes pulses of approximately 200 $\mu$sec in duration at a frequency of approximately 50 kHz. Of course, other pulse durations and frequencies may be used depending on the characteristics of the system components. The pulses are repeated at a rate according to the blink mode and blink routines described above. That is, the pulses are repeated at a rate according to antenna alignment errors.

Capacitor 318 provides AC coupling of One Shot 320 to cable 312, allowing the blink signal to pass but preventing the DC power signal from doing so. One Shot (i.e., monostable multivibrator) 320 produces a pulse of fixed duration in response to the pulses of the blink signal and provides the fixed duration pulses to LED 314. In response, LED 314 will be activated (i.e., will turn on). The variations in the time between pulses of the blink signal will thus be reflected at LED 314. The minimum pulse width for the blink signal pulses must be of sufficient duration to activate One Shot 320 while the minimum time between such pulses must be at least equal to the reset time of One Shot 320.

Thus, a novel antenna alignment indicator system for a satellite receiver has been disclosed. Although discussed with reference to specific embodiments and the accompanying illustrations, it should be appreciated that the present invention is applicable to a variety of antenna alignment indicator systems. For example, the alignment indicating system may be employed as part of a radio direction finding aid, a microwave antenna alignment system, or other systems requiring accurate antenna alignment. Accordingly, the invention should only be measured in terms of the claims which follows.

What is claimed is:

1. An apparatus for aligning an antenna, comprising:

means for detecting a received signal strength of a signal received at said antenna;

means for generating an indication signal indicative of said received signal strength coupled to said means for detecting, said means for generating an indication signal configured to provide a first indication signal having a frequency proportional to said received signal strength and to provide a second indication signal having a frequency proportional to the inverse of a difference between a maximum received signal strength and a current received signal strength; and means for indicating said indication signal coupled to said means for generating, said means for indicating capable of responding to said first indication signal and said second indication signal.

2. An apparatus as in claim 1 wherein said first indication signal has said frequency proportional to said received signal strength when said received signal strength is greater than or equal to said maximum received signal strength.

3. An apparatus as in claim 2 wherein said second indication signal has said frequency proportional to the inverse of said difference between said maximum received signal strength and said current received signal strength when said received signal strength is less than said maximum received signal strength.

4. An apparatus as in claim 3 wherein said means for indicating comprises a light emitting diode (LED).

5. An apparatus as in claim 4 wherein said means for generating comprises a general purpose programmable device configured to receive a signal indicative of said signal received at said antenna, to derive said signal strength therefrom and to provide one of said first indication signal or said second indication signal in accordance therewith.

6. An apparatus as in claim 5 wherein said general purpose programmable device is a processor coupled to a medium storing computer readable instructions which when executed by said processor cause said processor to derive said signal strength from said signal indicative of said signal received at said antenna and to provide one of said first indication signal or said second indication signal.

7. An apparatus as in claim 3 wherein said means for indicating comprises an audio tone generator.

8. An antenna alignment system comprising:

an antenna configured to receive a signal from a source;

an alignment error detector coupled to said antenna, said alignment error detector configured to produce a variable frequency intermediate signal indicative of an antenna pointing error, said antenna pointing error associated with a relative alignment of said antenna with respect to said signal;

an antenna alignment indicator coupled to receive said intermediate signal and configured to provide an indication of said antenna pointing error in response thereto, wherein said alignment error detector responds to a signal strength of said signal by determining whether a current signal strength is greater than or equal to a prior maximum signal strength and, if so, producing said intermediate signal so that said intermediate signal has a frequency proportional to said current signal strength, otherwise producing said intermediate signal so that said intermediate signal has a frequency proportional to the inverse of the difference between said maximum signal strength and said current signal strength.

9. An antenna alignment system as in claim 8 wherein said alignment error detector comprises a processor coupled to a storage medium having stored therein computer readable instructions which when executed by said processor cause said processor to respond to said signal strength and generate said intermediate signal in accordance therewith.

10. An antenna alignment system as in claim 8 wherein said antenna alignment indicator comprises a light emitting diode (LED).

11. An antenna alignment system as in claim 9 wherein said antenna alignment indicator comprises an audio signal generator.

12. A method for determining optimal alignment of a receiving antenna, comprising the steps of:

(a) receiving a signal at an antenna and detecting a received signal strength of said signal;

(b) indicating said received signal strength by activating an indication device and periodically deactivating said indication device at a rate proportional to said received signal strength;

(c) adjusting the alignment of said antenna with respect to said signal and repeating step (b) so long as said received signal strength increases or remains constant in magnitude;

(d) detecting a decrease in said magnitude of said received signal strength and modifying said indication of said received signal strength by activating said indication device at a frequency proportional to the inverse of the difference between a maximum received signal strength and a current received signal strength.

* * * * *